US011341836B2

(12) United States Patent
Gomez et al.

(10) Patent No.: US 11,341,836 B2
(45) Date of Patent: May 24, 2022

(54) PERSISTENT MONITORING AND REAL TIME LOW LATENCY LOCAL CONTROL OF CENTRIFUGAL HYDRAULIC PUMP, REMOTE MONITORING AND CONTROL, AND COLLECTING DATA TO PRODUCE PERFORMANCE PROFILES

(71) Applicants: Arturo Camacho Gomez, San Diego, CA (US); Richard Park, San Diego, CA (US)

(72) Inventors: Arturo Camacho Gomez, San Diego, CA (US); Richard Park, San Diego, CA (US)

(73) Assignee: Field Intelligence, Inc., San Diego, CA (US)

( * ) Notice: Subject to any disclaimer, the term of this patent is extended or adjusted under 35 U.S.C. 154(b) by 0 days.

(21) Appl. No.: 16/893,412

(22) Filed: Jun. 4, 2020

(65) Prior Publication Data

US 2020/0388140 A1 Dec. 10, 2020

Related U.S. Application Data

(60) Provisional application No. 62/858,913, filed on Jun. 7, 2019.

(51) Int. Cl.
*G08B 21/18* (2006.01)
*F04B 49/06* (2006.01)

(52) U.S. Cl.
CPC ..... *G08B 21/182* (2013.01); *F04B 49/065* (2013.01)

(58) Field of Classification Search
CPC combination set(s) only.
See application file for complete search history.

(56) References Cited

U.S. PATENT DOCUMENTS 6,260,004 B1 * 7/2001 Hays ..... F04D 15/0088 702/183
6,289,735 B1 * 9/2001 Dister ..... G01H 1/003 73/579

(Continued)

OTHER PUBLICATIONS

What is SCADA? Sep. 12, 2018, Inductive Automation; p. 1. (Year: 2018).*

*Primary Examiner* — Nabil H Syed
*Assistant Examiner* — Cal J Eustaquio
(74) *Attorney, Agent, or Firm* — Continuum Law; Robert P. Cogan

(57) ABSTRACT

An apparatus, method, and a non-transitory programmed medium provide real time, in-situ, persistent monitoring of a pump for the presence of anomalies and controlling pump operation to avoid a failure. Real time operating data is compared to profiles to indicate out of limit operation and to generate dynamic control signals. A vibration sensor which measures amplitude of vibration generated by the pump and at least one thermocouple provide data to a first processor collocated with the pump to enable low latency reaction. Spectral analysis is performed by the first processor. Additional operating parameter values are obtained and provided to a second processor, a remote processor or a cloud server. At least one of the processors provides signals to modulate controls to vary engine speed or shut down the engine. A cellular modem and a satellite modem interface the system and external nodes. Data collected are correlated with operating data to generate profiles indicative of conditions.

5 Claims, 10 Drawing Sheets

(56) References Cited

U.S. PATENT DOCUMENTS

| | | | | |
|---|---|---|---|---|
| 6,330,525 | B1 | 12/2001 | Hays et al. | |
| 6,709,241 | B2 | 3/2004 | Sabini et al. | |
| 7,539,549 | B1 * | 5/2009 | Discenzo | F04D 15/0077 324/765.01 |
| 9,564,652 | B2 | 2/2017 | Bocquet et al. | |
| 10,047,741 | B2 | 8/2018 | Zhang et al. | |
| 10,134,257 | B2 | 11/2018 | Zhang et al. | |
| 2003/0236649 | A1 * | 12/2003 | Kodukula | C02F 1/008 702/188 |
| 2006/0100797 | A1 | 5/2006 | Poorman et al. | |
| 2017/0213451 | A1 | 7/2017 | Potucek et al. | |
| 2018/0324504 | A1 * | 11/2018 | Tang | G08B 21/185 |

* cited by examiner

PERSISTENT MONITORING AND REAL TIME LOW LATENCY LOCAL CONTROL OF CENTRIFUGAL HYDRAULIC PUMP, REMOTE MONITORING AND CONTROL, AND COLLECTING DATA TO PRODUCE PERFORMANCE PROFILES

CROSS REFERENCE TO RELATED APPLICATION

This patent application claims priority to U.S. Provisional Patent Application Ser. No. 62/858,913 filed Jun. 7, 2019, which is incorporated herein by reference in its entirety.

FIELD

The present subject matter relates to diagnostic analysis and dynamic control of pumps, including measurement of vibration and cavitation and generation of control curves, and deriving profiles, signatures, and other intelligence from measurements.

BACKGROUND

Large capacity pumps driven by diesel engines represent a major capital investment. A preferred example of a pumping system is disclosed in commonly assigned U.S. Pat. No. 9,127,678 entitled Fast-Response Pump Monitoring and In-Situ Pump Data Recording System, which is incorporated herein by reference in its entirety.

Monitoring of pumps is essential in order to identify current operating issues. Monitoring is also very important for predicting future problems and for performing preventive maintenance. The server can perform higher level analytics using previously acquired data in order to predict future performance and establish trends. The major categories of failure modes for centrifugal pumps are hydraulic failure modes and mechanical failure modes. The cost of a failure is high. Many pumping systems cost in excess of $100,000.

The primary hydraulic failure modes are cavitation, pressure pulsation, pump recirculation, and radial and axial thrust. Cavitation is the formation of bubbles in a moving fluid. Cavitation damage includes erosion, noise, vibration, and loss of efficiency. Suction and discharge pressure pulsations may cause instability of pump controls, vibration of suction and discharge piping, and high levels of pump noise. Radial thrust can lead to packing or sealing problems or shaft failure. Heavy radial thrust will cause cracking in balls or rollers in bearings supporting an impeller shaft. Mechanical failure modes include shaft seizure or break, bearing failure, seal failure, vibration, and fatigue.

Capabilities of prior art systems have been limited in providing instrumentation to sense forms of failure modes and in maximizing the information obtained from sensors. Prior methods include calculation of net positive suction head (NPSH), measurement of audible changes in pump operation, and collection of vibration data for offline analysis.

U.S. Pat. No. 10,134,257 discloses a system in which pumping speed and/or inlet pressure can be varied responsive to the predetermined value to limit cavitation in the pump. The patent discloses populating a data structure with a plurality of bore pressure values between a pump inlet and a pump outlet and mapping the plurality of bore pressure values in the data structure. A cavitation threshold model is constructed that is based on a subset of the plurality of bore pressure values and a vapor pressure of the liquid. This method requires multiple measurements to construct the model and does not provide for predictive use of sensor outputs.

U.S. Pat. No. 10,047,741 discloses a monitoring system for a fluid pump having a fluid end and a power end. An inlet pressure sensor generates a signal indicative of an inlet pressure of a fluid. A discharge pressure sensor attached generates a signal indicative of a discharge pressure. An accelerometer at the fluid end generates a signal indicative of vibration. A controller receives signals from the sensors and determines a possible failure mode of the fluid pump. This system provides a limited amount of diagnostic data.

U.S. Pat. No. 9,546,652 discloses monitoring and controlling of a positive displacement pump using readings obtained from a plurality of pressure sensors. The pressure sensors may be mounted at the suction, discharge, and interstage regions of the pump. Signals from the pressure sensors are compared to obtain a ratio that is used to predict whether a cavitation condition exists within the pump. The system relies on calculating pressure differentials. The system does not have inputs each indicative of one of a plurality of parameters to be used. Although historical information regarding the ratios may be used to predict whether gas bubbles are passing through the pump, the system is limited to action based on pressure and not on other parameters. This system does not provide for sensing a plurality of parameters.

U.S. Pat. No. 6,709,241 discloses a controller for controlling operating parameters associated with fluid flow, speed, or pressure for a centrifugal pump wherein at least one sensor is coupled to the pump for generating a signal indicative of a sensed operating condition. The controller comprises a storage device for storing data indicative of one or more operating conditions and a processor to perform an algorithm utilizing the at least one sensor signal and the stored data indicative of the at least one operating condition to generate a control signal, wherein the control signal is indicative of a correction factor to be applied to the pump. This system only performs closed loop error correction. It does not control overall operation of the pump.

United States Patent Application Publication No. 2017/0213451 discloses a pool control system for controlling a parameter of the pool environment. However, this system is primarily concerned with connectivity in the Internet of Things rather than industrial control.

U.S. Pat. No. 6,330,525 discloses a system used with pumps and other rotating machinery intended to provide diagnostics for indicating impending failure, validating correct installation, and diagnosing change in the operation of a rotating machine and ancillary equipment attached to the machine. Current pump signature curves and operating points resulting from the acquisition of process variables from sensors that measure selected current conditions are compared to the original data in the form of an original or a previous pump performance signature curve from prior monitoring, and knowledge of the rotating equipment or pump geometry, installation and piping geometry, ancillary equipment knowledge and geometry, and properties of the pumped fluid. The diagnosis requires use of detailed input information and does not provide for learning.

United States Patent Application Publication No. 2006/0100797 discloses a vibration monitoring system. A vibration diagnostic software system integrated with a process automation system and a computerized maintenance management system provides a single window interface for controlling and monitoring a process, for monitoring and analyzing the vibration of the machines associated with the process, and for managing the maintenance of the machines. Vibration data collection, transmission, analysis, historical recording, display, and maintenance are integrated in a defined workflow. This system requires a human system interface. This system focuses on the use of vibration data. This set of data collected on one machine does not provide a basis for applying the data to other machines.

Pump prior art systems have focused on operation to present information to a user. Information has included notice of required maintenance and predictions of future needs for replacement of components. These prior art systems do not utilize vibration data in order to validate correlation of vibration information with the existence of a particular problem, and are unable to provide a basis for applying the data to other machines. In not using the vibration data, it is also not followed by measurement of other operating parameters and operational experience in order to make predictions. The prior systems do not learn from data in order to create new rules allowing evaluation of pumps without the need to monitor real time operating parameters.

There is a need for industry standard methods for monitoring cavitation, such as calculation of net positive suction head (NPSH), audible changes in pump operation, and ultrasonic cavitation monitoring by acoustic noise power measurement. Current systems for diagnosing current operation and sensing need for preventive maintenance lack simplicity in use and have limitations in the range of apparatus for which they can provide useful information. Noise and other factors can mask signals, making it more difficult to perform diagnosis.

SUMMARY

Briefly stated, in accordance with the present subject matter, an apparatus, method, and a non-transitory programmed medium are provided for real time, in-situ, persistent monitoring of a pump for the presence of cavitation in operating environments, controlling pump operation to remain within preselected limits or to shut down the pump in order to avoid a failure, and performing learning in order to generate profiles that can indicate present conditions or predict future consequences of operation. Sensor measurements are processed to provide dynamic control of pump operation. A local processor responds to the measurement of operating data to derive current status to determine if operation is within operating specifications of the pump. A vibration sensor measures the amplitude of vibration that is being generated by the pump and engine. Spectral analysis is performed on this data by a computer which is collocated with the sensor and the pump. The computer is attached to the sensor via a cable. The housing which contains the computer is mounted on the pump. A three-axis accelerometer and at least one thermocouple provide data for basic detection of cavitation for low latency local control. Processing can be done on site by a first processor for conditions which need to be handled with low latency, e.g., cavitation. Additional operating parameter values are obtained and provided to a second processor, which may be a remote processor or a cloud server. At least one of the processors provides signals to modulate controls to vary speed of the engine or if necessary shut down the engine. A cellular modem and a satellite modem provide for interconnectivity through cellular service and satellite communications for interfacing the system and external nodes. This system has the capacity to collect data over extended periods of time and develop profiles of data that correlate with operating conditions. Algorithms are used to generate further correlations of collected data to predict other qualities, such as predicted engine life. A remote processor interacts with the first processor to process signals representing the values of additional operating parameters. The remote processor cooperates with the first processor to control operation. Real-time data values are compared with a profile indicative of an out of limit condition or other quality characterizing the status of the pump. Additional processing of data can be performed offsite to establish trends and predictions based upon real-time and historical data. The data may also be used to generate signatures whereby maximum intelligence is derived from a limited amount of data.

DETAILED DESCRIPTION

The present subject matter includes a centrifugal pump monitoring system for real-time, in-situ, persistent monitoring of a centrifugal pump driven by an engine and controlling selected operating conditions with low latency, a method for real-time, in-situ monitoring of performance of a centrifugal pump driven by an engine in operating environments, and a non-transitory machine-readable medium for real-time, in-situ monitoring of performance of a centrifugal pump driven by an engine in operating environments that provides instructions, which when executed by a processor, causes a processor to perform operations. Collected data is utilized to provide profiles and signatures comprising stored data sets based on historical data to which real-time operating parameter values may be compared.

The present subject matter provides for efficient local control in reacting to parameters requiring response having low latency, for interaction with a remote processor and users, and for collecting data for use to extend the life of a centrifugal pump. Pumping systems generally represent a large capital investment. Improvements in their operation can materially improve return on investment (ROI). A method, apparatus, and programmed medium for execution on a digital processor allows an owner or lessee of a pumping system to control operation of a centrifugal pump to remain within a preselected range of operating parameters for the respective pump and to predict likely events that could damage the pump. It is also for monitoring a pump and engine requiring a low latency reactive control for varying operating parameters or shutting the pump down in response to real-time data indicative of a failure, such as presence of cavitation or other out of limit conditions.

Figure 1:
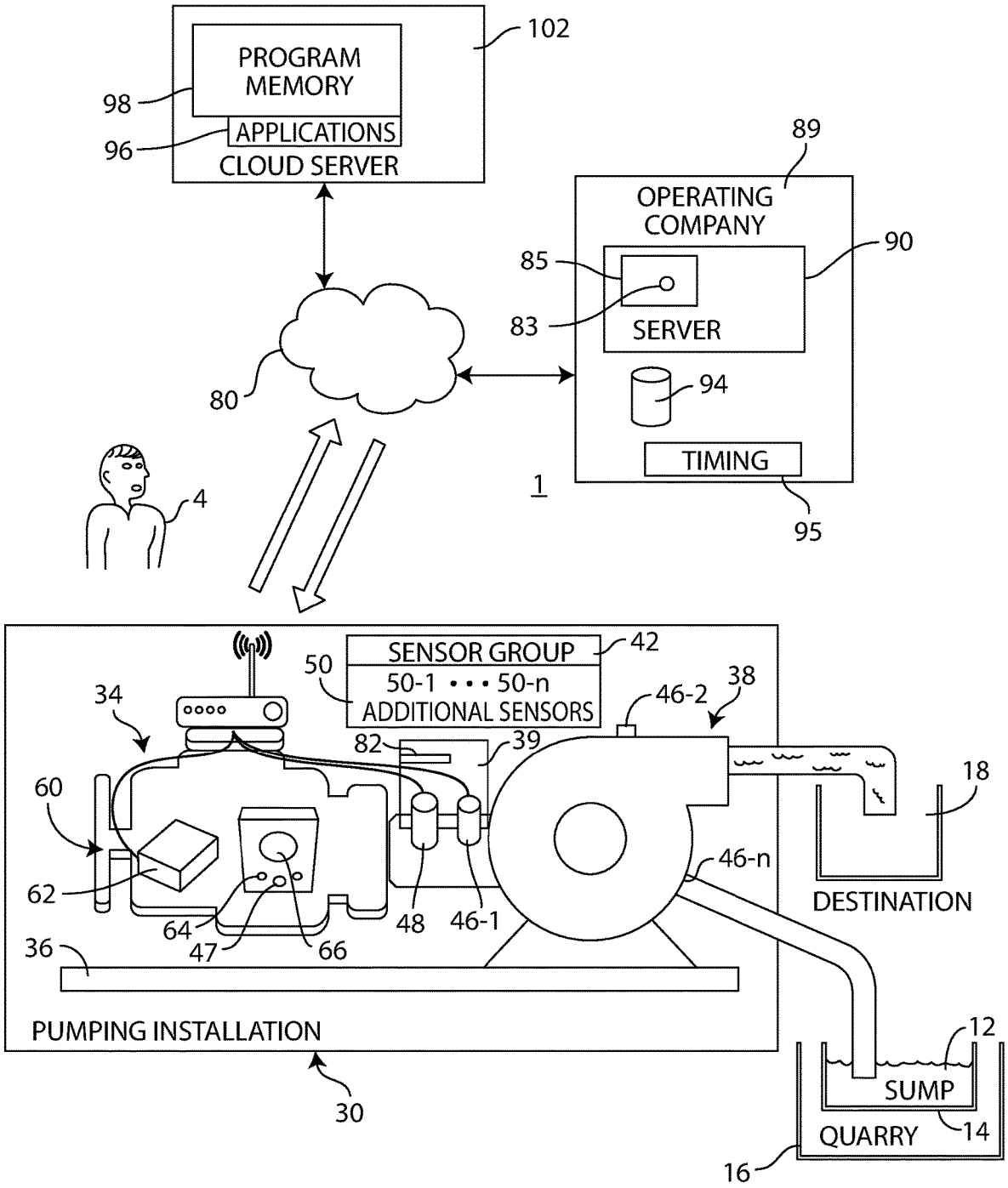
FIG. 1 is an elevation of a system according to the present subject matter including an engine driving a pump.

FIG. 1 is an elevation of one example of a system utilizing the present subject matter including an engine driving a pump. In this illustration, significant amounts of water 12 are moved from a selected location. In the present illustration the location is a sump 14 in a quarry 16. In one nominal application "a significant amount of water" is 1,800 gallons per minute. The water 12 collected in the sump 14 must be lifted to a location out of the perimeter of the quarry 16 in order to prevent reflooding of the sump 14. The water 12 is moved to a destination 18 such as a body of water into which the water 12 can be legally dumped.

FIG. 1 discloses a centrifugal pump monitoring system 1 for real-time, in-situ, persistent monitoring of a centrifugal pump 38 driven by an engine 34 and controlling selected operating conditions with low latency. FIG. 1 includes an elevation, partly in block diagrammatic form, of a pumping installation 30 including the engine 34 driving the centrifugal pump 38. The engine 34 and centrifugal pump 38 are mounted on a skid 36. Pumping installations 30 are generally used in applications in which the pumping installation 30 is placed in one location for a limited period of time. Pumping instillations 30 are generally not permanently installed. The skid 36 allows for mobility. The engine 34 is preferably a diesel engine 34 and drives the centrifugal pump 38 to pump the water 12 from the sump 14. One example of a suitable centrifugal pump 38 is the type XH150, which is made by a number of manufacturers. This pump provides a maximum pumping capacity of 2350 gallons per minute (GPM), and a maximum head of 605 feet, or 184 meters. The volute of a centrifugal pump is the casing that receives the fluid being pumped by the impeller. The volute is made of ductile iron; the impeller may be of stainless steel or chromium.

A sensor group 42 comprises a plurality of sensors each positioned to gather selected information describing operation of the pump 38. Sensors include a vibration sensor 44. In one preferred form, the vibration sensor 44 comprises a three-axis accelerometer 48. The vibration sensor 44 is mounted on a main bearing housing of the pump 38 for alignment with a pump impeller drive shaft (not shown) to the centrifugal pump 38 to monitor an amplitude of vibration generated by the engine 34 and the pump 38. A temperature probe, or sensor, 46-1, preferably comprising a thermocouple, is mounted to sense temperature at one location on the pump 38 and provide data indicative of temperature at a respective location. Generally the thermocouple will provide an analog output to an analog to digital computer to provide a digital representation of the temperature. Additionally, temperature sensors 46-2 through **46-*n*, where n is a natural number, may also be provided. Each temperature probe 46 is located at a preselected separate location on the pump 38. Additional data is collected by measuring temperature data with thermocouple temperature probes 46 at each of a plurality of points on the pump and converting the measurements to digital representations of temperature Vibration and temperature are primary operating parameters used to track out of limits operation and cavitation. These parameters are important in detecting cavitation and other undesired conditions. To enable the system to react effectively, the sensing of these two operating parameters must have low latency, i.e., results must be provided substantially in real time. The results must be provided for processing and provision of commands to controls 47 (FIG. 2**) to adjust operating parameters values sufficiently quickly to avoid out-of-limits operation or pump failure.

At least one temperature probe 46 is provided. Each temperature probe is located at a preselected location at a preselected point of the structure of the pump 38. Each temperature probe 46 provides data indicative of a temperature at a respective location and is coupled to provide data to the first processor 82. A second processor 83 and data storage, or memory, 94 comprise programs for performing analysis of data received over a selected period of time. The first processor 82 stores a stored profile indicative of an out-of-limit condition in the pump and compares real-time data with the stored profile and provides an alarm signal in response to correlation of the real-time data with the profile indicative of the out of limit condition. A vibration measurement that is provided comprises time series data in units of distance per time period. The second processor 83 is coupled to said first processor 82 via a network or modem and further coupled to receive the additional operating parameters. The second processor 83 comprises the memory 94 and timing circuitry 95 to accumulate historical data for correlation with operating conditions for a pump. The second processor 83 further comprises a learning program for correlating received data with operating conditions of a pump. The second processor 83 collects performance data over preselected periods of time, correlates the performance data with operating conditions, and performs higher level analytics on stored sets of collected data to establish future performance and to establish trends over the lifetime of the pump 38.

The sensor group 42 may further comprise additional sensors 50-1 to **50-*n*** to measure values of additional operating parameters such as engine rpm, engine coolant temperature, engine oil pressure, engine load, engine soot level, engine soot load, engine ash load, engine diesel exhaust fluid (DEF) level, engine running hours, engine fuel level, engine fuel rate, engine j1939 alarms, pump suction pressure, pump discharge pressure, pump flow rate, and engine battery voltage. Diesel exhaust fluid is a non-hazardous solution comprising 32.5% urea and 67.5% de-ionized water. DEF is sprayed into the exhaust stream of diesel vehicles to break down dangerous NOx emissions into harmless nitrogen and water. Engine commands include engine on, engine off, and set rpm.

Data indicative of all operating parameters is combined into a single data structure in the first processor, the data structure represents the state of the pump and the engine at the point in time at which the data was sampled. The data structure is provided to a stored profile indicative of an anomaly in operation of a preselected pump, the stored profile has a value correlated to a bandwidth that is predictive for an out of limit condition. The signal in the frequency domain is analyzed to determine if there is a rise in signal within a window corresponding to a bandwidth that is predictive for cavitation. If the signal within that band is above a reference threshold then an output is produced indicating a positive test for cavitation.

Figure 2:
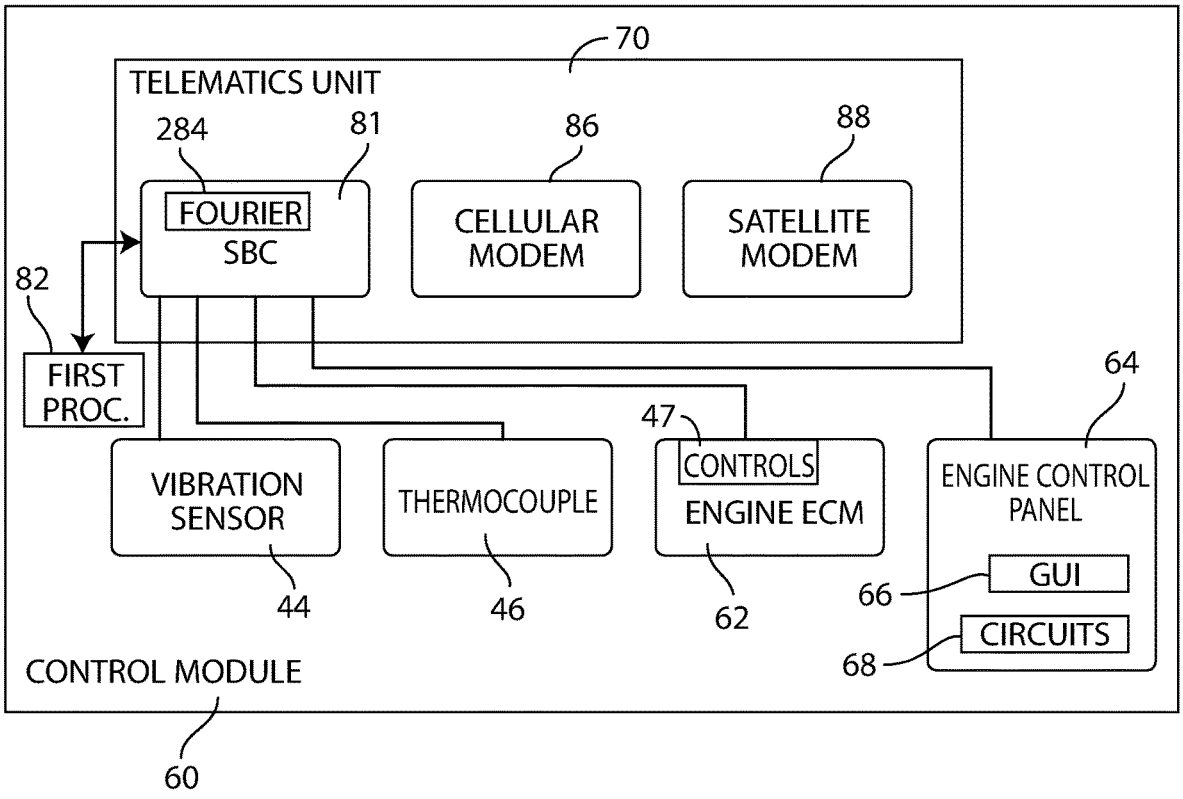
FIG. 2 is a partial detailed view of FIG. 1 illustrating the telematics module 70 in greater detail, showing the interconnection of operating components.

FIG. 2 is a partial detailed view of FIG. 1 illustrating the telematics module 70 in greater detail, showing the interconnection of operating components. Operation measurements and operating commands are provided to and from a control module 60. The control module 60 preferably includes an engine electronic control module (ECM) 62 and a control panel 64 which may comprise a user interface, such as a graphical user interface (GUI) 66 and circuits 68 for receiving user-entered information. A user interface provides information to one or both of the first, local processor 82 and the remote processor 85 embodying intelligence for coupling to the engine control module 60. The cloud server 102 provides an interface through which a user 4 can remotely monitor and control a remote asset. The interface consolidates the analytics output of the single board computer (SBC) 81 and cloud server 102 into a human readable format. Feedback from the cloud server 102 and the user 4 is sent back to SBC 81 wirelessly. The first processor 82 is part of the SBC 81. SBC 81 makes adjustments based upon feedback. The cloud server 102 is interfaced to the GUI 66 to allow a user 4 to remotely monitor and control the pump and at the interface consolidate the analytics output of the first processor 82 and the cloud server 102 into a human readable format. The sensor group 42 and the control module 60 are connected to a telematics module 70, which is a communications interface. The telematics module 70 may interface with the Internet 80. In one business model, an operating company 88 may operate and control functioning of the system 1. The operating company may be a lessee or owner of the pumping installation 30.

The telematics module 70 may be coupled via the Internet 80 to a company server 90. The company server 90 includes memory, or data storage 94, such as an SQL database. The telematics module 70 further comprises a cellular modem 86 and a satellite modem 88. The cellular modem 86 and the satellite modem 88 provide for interconnectivity through cellular service and satellite communications for interfacing the system and external nodes. External nodes include the second server 83, cloud server 102, and the graphical user interface 66. Operating applications 96 are stored in a program memory 98. The operating applications 96 include algorithms for processing data received from the pumping installation 30, and may provide commands to the pumping installation 30, logging values of operating parameters measured by the sensor unit 42 and processed by the SBC 81 over preselected time intervals. The data from all sources is combined into a single data structure in the SBC 81 by the first processor 82. The data structure represents the state of the pump 38 and engine 34 at the point in time at which the data was sampled. The data structure is input into a collection of algorithms in the first processor 82. The algorithms can detect anomalies and determine optimal settings for controllable variables like RPM.

Operating applications 96 may also be maintained in a cloud server 102 and accessed from the cloud server 102. Either or both of the company server 90 and the cloud server 102 may be included in the system. The second processor 83 may comprise the cloud server 102. The company server 90 or the cloud server 102 or both may each be referred to as a second processor 83 or as a remote processor 85 depending on the context and corresponding data flow. The first processor 82 may determine sets of events which should be reported to the cloud server 102. The data is reported to the cloud server 102 and data is collected over preselected periods of time. Sets of collected data are correlated with operating conditions to establish signatures. In the first processor 82, a log of the measurements from the sensor group 42 is created. In one form, the log is a record of sensor measurements made at 1 minute intervals. The log goes back in time, for example going back one year. Items that may be stored include configuration data for the sensors, parameters for the various predictive and reactive algorithms, alarms generated, e.g., cavitation alarm, all parameter values, and event based data such as engine on and engine off. Data is stored for one of a number of time periods, the time period could include the life of the pump 38. Certain functions are performed at a local processor, the first processor 82, certain functions are performed at the remote processor 85, which may be the second processor 83, the company server 90 or the cloud server 102 and functions may be shared between the first processor 82 and the remote processor 85.

Sensors providing signals from the pumping installation 30 and controls 47 utilizing the values provided from the pumping installation 30 are coupled to and from a single board computer (SBC) 81 in the telematics module 70. The SBC 81 interacts with a first processor 82. The first processor 82 is collocated with the pump 38, with the three-axis accelerometer 48 included in the vibration sensor 44 (FIG. 2) and the centrifugal pump 38. The first processor 82 is coupled to receive signals from the vibration sensor 44, and performs spectral analysis of the signals. The analysis comprises translation from a first domain to a second domain and provides data indicative of values in the second domain. The first processor 82 is in a housing 39 which is mounted to the centrifugal pump 38. As in FIG. 1, the telematics module 70 provides for communication between the pumping installation 30 and external networks. In one preferred embodiment, the telematics module 70 comprises the SBC 81, a cellular modem 86, and a satellite modem 88. The vibration sensor 44, the thermocouple(s) 46-*n*, the engine ECM 62, and the engine control panel 64 are each coupled to the SBC 81. The arrangement of FIG. 2 enables remotely located entities, such as the operating company 88, to monitor the pumping installation 30 in real time, store information received from the pumping installation 30, and to send information or commands to the pumping installation 30.

Figure 3:
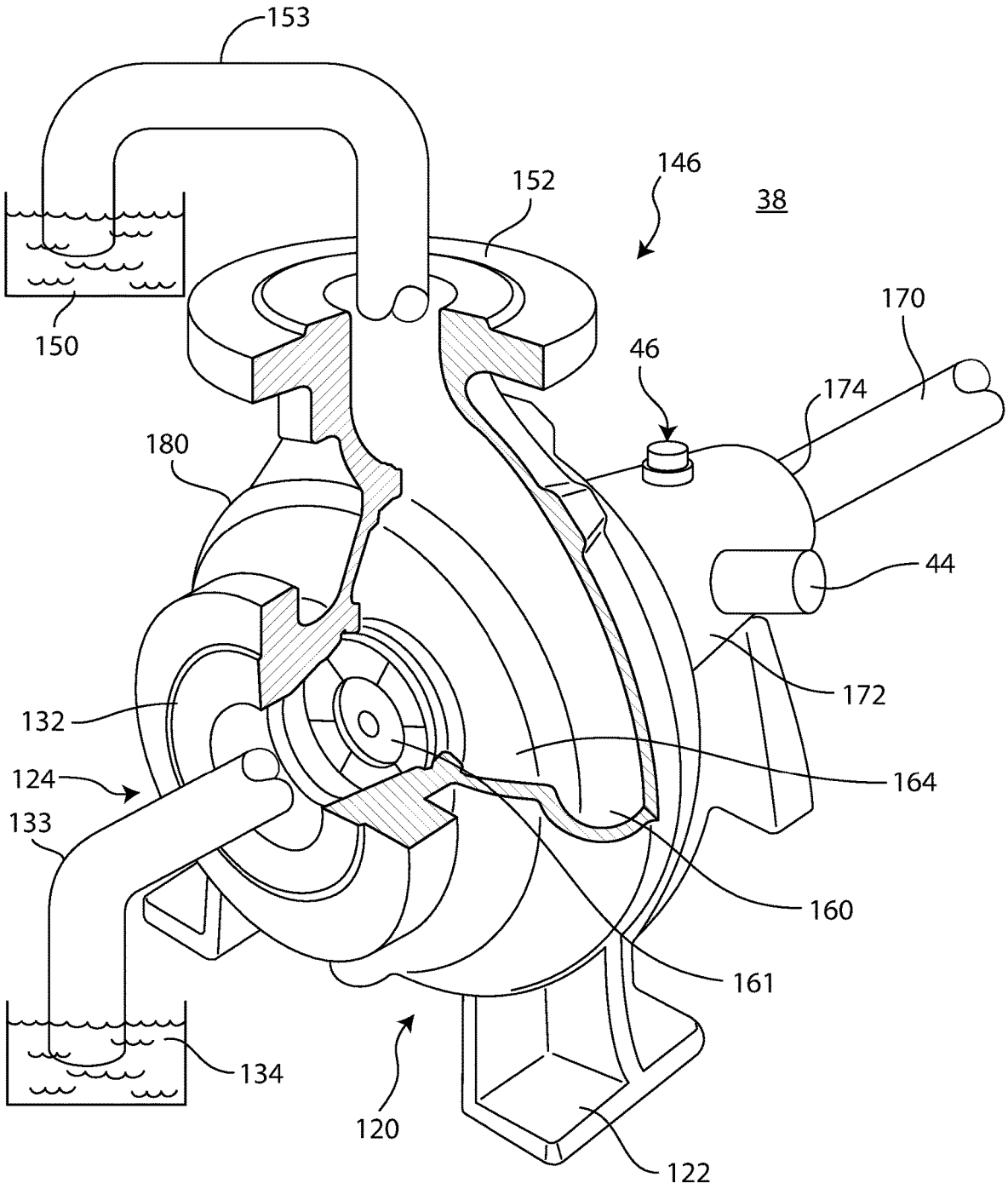
FIG. 3 is an isometric view, partially broken away of the pump of FIG. 1.

FIG. 3 is an isometric view, partially broken away of the centrifugal pump 38 of FIG. 1. The pump 38 comprises a pump casing 120 resting on a base 122. A suction side 124 is coupled at an upstream pipe flange 132 to a conduit 133 communicating with a source of liquid 134. A pressure side 146 is coupled at a downstream pipe flange 152 to a conduit 153 which provides pumped liquid to a utilization destination 154. Incoming liquid is received in a volute chamber 160. An impeller 164 pumps liquid from the volute chamber 160 to exit from the pressure side 146. The impeller 164 is driven by a driveshaft 170 received by a driveshaft flange 174. A rotation indicator 180 is mounted in the pump casing 120 adjacent the impeller 164 to indicate direction of rotation of the driveshaft 170. The vibration sensor 44 is mounted to the pump casing 120. The vibration sensor 44 is in a location selected to provide the most meaningful data. In the present embodiment, the vibration sensor 44 is mounted adjacent the driveshaft flange 174. The thermocouple 46 is located to measure temperature of shaft bearings 161 and volute chamber 160. The thermocouple 46 output will be logged as a temperature for further offline analysis.

While the main bearing housing 172 is the preferred location for the vibration sensor 44, data may be gathered from other locations to determine empirically what the preferred vibration sensor 44 location is to receive selected modes of vibration. Similarly, the temperature sensors 46 may be tested at various locations in order to resolve temperature profiles in various surroundings.

Figure 4:
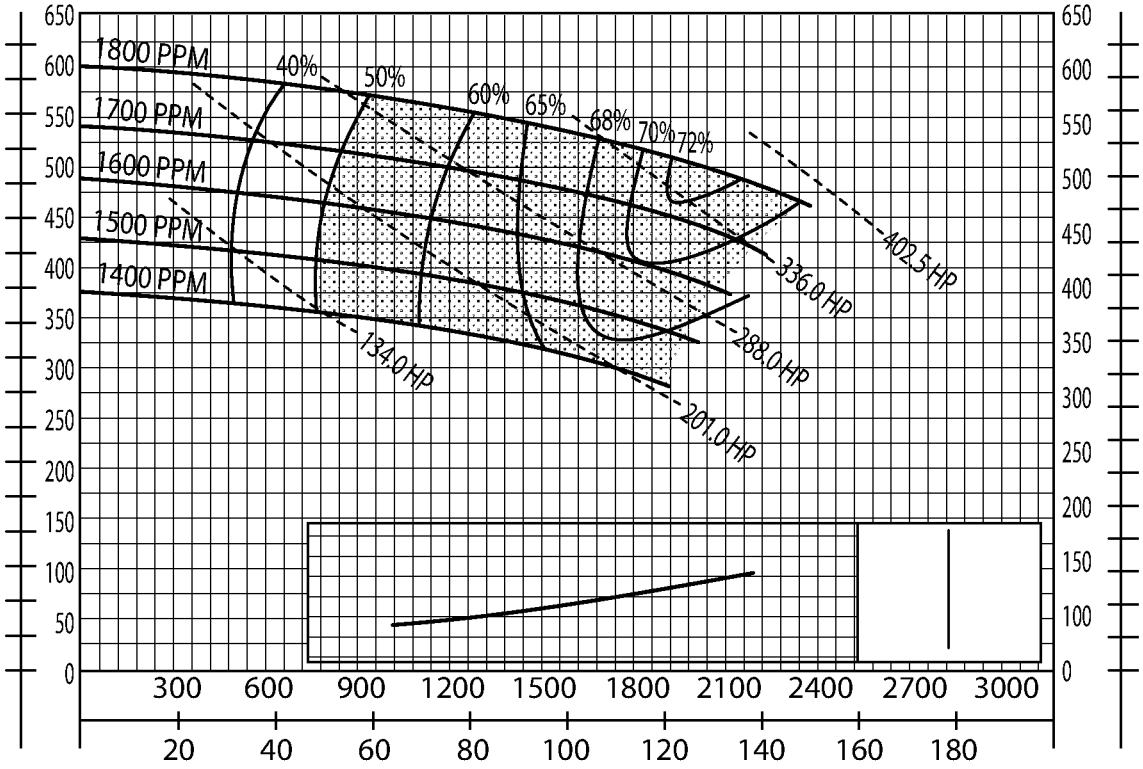
FIG. 4 illustrates nominal operating curves for a selected pump for use in conjunction with selected measured parameters.

FIG. 4 illustrates nominal operating curves for a selected centrifugal pump 38 for use in conjunction with selected measured parameters. The abscissa is flow in both metric and English units, and the ordinate is maximum head in meters and feet for a selected pump. In a preferred embodiment, the pumping installation 30 (FIG. 1) comprises the centrifugal pump 38. Fluid enters the pump through the eye of an impeller 164 which rotates at high speed. The fluid is accelerated radially outwardly. A vacuum is created at the impeller's eye that continuously draws more fluid into the pump 38 and discharges the fluid to create head. A pump's head indicates a difference between input pressure and output pressure. Head is the vertical lift in height, generally measured in feet or meters of water 12, to which the pressure generated by the pump 38 can lift water 12. Head is measured vertically from a centerline of the pump 38 to the height of a discharge outlet. This is also known as static head. Dynamic head is the sum of static head and friction in the pump's suction. Dynamic head is a value used in horsepower calculations for pump operation. The SBC 81 analyzes the spectral data from the vibration sensor 44 in order to identify cavitation. The pump curves can be used to modulate RPM and flow so that the pump is operating at its best efficiency point with respect to the other measurements which are available. The operating parameters of the pump 38 are modulated by controls 47 for conditions which require a low latency response and the modulation magnitude is determined in response to comparison of real-time operating parameters to a stored profile. Use of the pump curves may determine net positive suction head required (NPSHr), best efficiency point (BEP), and minimum flow.

In the present illustration, an XH150 centrifugal pump is used. The main use is dewatering operations. One example of a common dewatering application is pumping water out of pit mines following an event which causes water to collect at the bottom of the pit, e.g. rain or rising groundwater level. In one scenario, a single pump is inadequate to provide the necessary lift which is required to move the water from the bottom of the mine to a drainage point at a higher location. In this scenario multiple pumps work in series to provide the necessary head. The pump size corresponds to the rate at which water needs to be moved and varies depending upon the job. The XH150 pump is an end suction centrifugal pump with an automatic priming system. The priming system utilizes a standard air compressor, which feeds a pneumatic ejector mounted above the air/water separation tank. With this device, suction lifts up to 28 ft. (8.5 m) can be achieved. The pump uses an impeller with a five blade, stainless steel closed construction design, with an eye diameter of 6.85" (174 mm). The impeller is mounted on a 431 stainless steel shaft fitted to a cast iron bearing bracket; which also provides concentric location for the pump volute. A number of manufacturers make an XH150 pump. One example is the Power Prime® XH150 pump available from Western Oil Services.

Each curve in FIG. 4 illustrates head versus flow rate for one value of rotational speed of the impeller 164 of the pump 38. The SBC 81 measures engine RPM using data from the engine ECM 62 for modern electronic diesel engines which are so equipped. Engines which do not use an engine ECM are known as mechanical engines. RPM is typically measured using a magnetic pickup that detects a signal from the flywheel. Impeller RPM can be calculated based upon engine rpm using data from the pump manufacturer. A centrifugal pump 38 operates at the point on its performance curve where its head matches the resistance in the pipeline. The point on the curve where the flow and head match the required performance is known as the duty point. A duty point can be established by varying such parameters as pump speed or impeller vane length.

Various conditions, e.g., change of height of water 12 in the utilization destination 154 (FIG. 3) can cause an operating point to move to the right as seen in FIG. 4. This may be characterized as a decrease in head and an increase in pump speed. When head versus pump speed decreases below a given level, cavitation results. Cavitation is the collapse of bubbles that are formed in the eye of the impeller 164 due to low pressure. The implosion of the bubbles on the inside of the vanes creates pitting and erosion that damages the impeller 164. In order to avoid allowing operation which will damage the pump 38, limits need to be determined for head versus pump speed.

Figure 5:
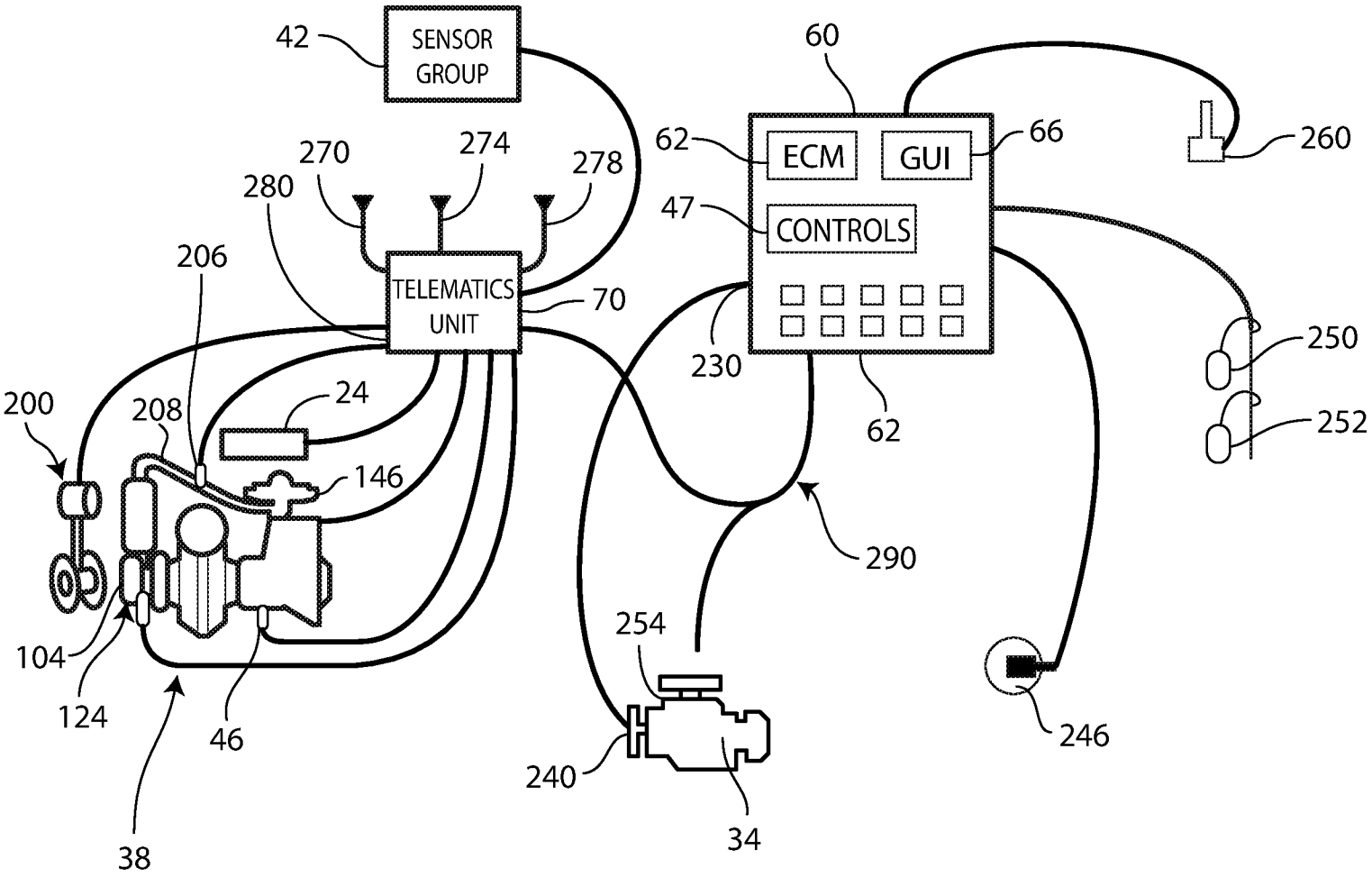
FIG. 5 is a block diagram of the system of FIG. 1 illustrating the flow of information including both the pumping system and telematics interconnections.

FIG. 5 is a block diagram of the system of FIG. 1 illustrating the flow of information via signal paths through both the pumping system and telematics interconnections. A flowmeter 200 is assembled in series with the suction side 124. A pressure gauge 206 is coupled in a conduit 208 which is connected between the suction side 124 and the pressure side 146. Each of the sensors coupled to the pump 38 are connected to the telematics unit 70. In one preferred embodiment, a direct current output of 4-20 ma may be provided.

The electronic control module 60 is connected to the engine 34. A stop/start output port 230 couples a control signal from the electronic control module (ECM) 62 to an ignition circuit 240 in the engine 34. A fuel level sensor 246 preferably provides a 0-5 volt signal to the electronic control module 60. Sensors 250 and 252 provide intelligence to the ECM 62 as well as some other sensor 260 which may provide an analog output of 4-20 ma.

Operation may be initiated at the ECM 60. A user 4 makes an entry into the GUI 66 to provide an ignition signal from the start/stop output port 230. The signal is coupled by the CAN bus 290 to the ignition circuit 240. The CAN bus 290 also provides communication between the ECM 62 and the telematics module 70. The engine 34 operates the driveshaft 170 to initiate pumping by the pump 38. The pumping installation 30 begins pumping water from the source 114 of liquid to the utilization destination 154.

Sensor group 42 begins monitoring operation. Each of the sensors in the sensor group 42 provide inputs to the telematics unit 70. The telematics unit 70 reports conditions in real-time to the first processor 82. The first processor 82 utilizes operating applications 96 (FIG. 1) in order to evaluate operation of the pump 38 in accordance with preselected criteria. The first processor 82 utilizes the pump curves of FIG. 4 to establish operation within limits. The parameters used in FIG. 4 are measured by the flowmeter 200 and the pressure gauge 206. The telematics module 70 makes information available to the cell network 270 and the satellite network 274. Cavitation is the most significant out of limit condition. When cavitation is sensed, the first processor 82 may communicate with the ignition circuit 240 to modulate controls 47 to vary speed of the engine 34, or, if necessary, shut down the engine 34. Modulating of controls comprises a range of preselected command options including shutting down said pump 38 in response to a comparison of real-time data with a profile indicating a failure threshold. The first processor 82 or second processor 83 will provide a signal to shut down the pump in response to an alarm signal. The pumping installation 30 may be self-regulating. If desired the operating company 88 (FIG. 1) may monitor, record, or override commands in the control module 60. The pump control circuitry 280 is responsive to the alarm signal to control operating parameters of the pump requiring low latency response. The pump control circuitry 280 is coupled to control pump speed and pump pressure in response to control signals generated in the first processor 82.

Remote monitoring and control of the pumping installation 30 is an extremely important capability for operating companies 88 that lease pumping installations 30 to users 4. It is possible to document time, place, and cause of damage to a pump 38. Specific information reduces costs of operating companies 88 in seeking and recovering damages from lessees.

Operation of the engine 34 is facilitated by use of further electronics. The data from sensors which provide input to the engine ECM 62 are used to optimize engine performance and reliability. For example, air flow sensors, temperature sensors, and fuel rate sensors, can work in conjunction to optimize the air/fuel ratio. Temperature sensors 46 can indicate a condition which could cause engine damage and failure. The engine ECM 62 is able to react to this information by de-rating or shutting down the engine. The fuel level sensor 246 provides real-time fuel level information to the engine ECM 62. Sensors 250 and 252 are float switches. They are immersed in a sump which causes the floating portion of the switch to adjust to sump level and send a signal when a predefined threshold is reached. They are commonly used with hydraulic pumps to automatically start and stop the engine according to sump level. Sensor 260 represents any number of analog sensors that may also be used during pump operations, e.g., external fuel tank level, flow meters, suction, and discharge pressure sensors and the like inform the ECM 62 of physical status around the engine 34. This helps to determine what physical attention is necessary to the engine 34. The ignition circuit 240 is wired to the conventional electronic control circuit for a diesel engine. Control circuits may be coupled, e.g., at a terminal 254 of the engine 34.

Figure 6:
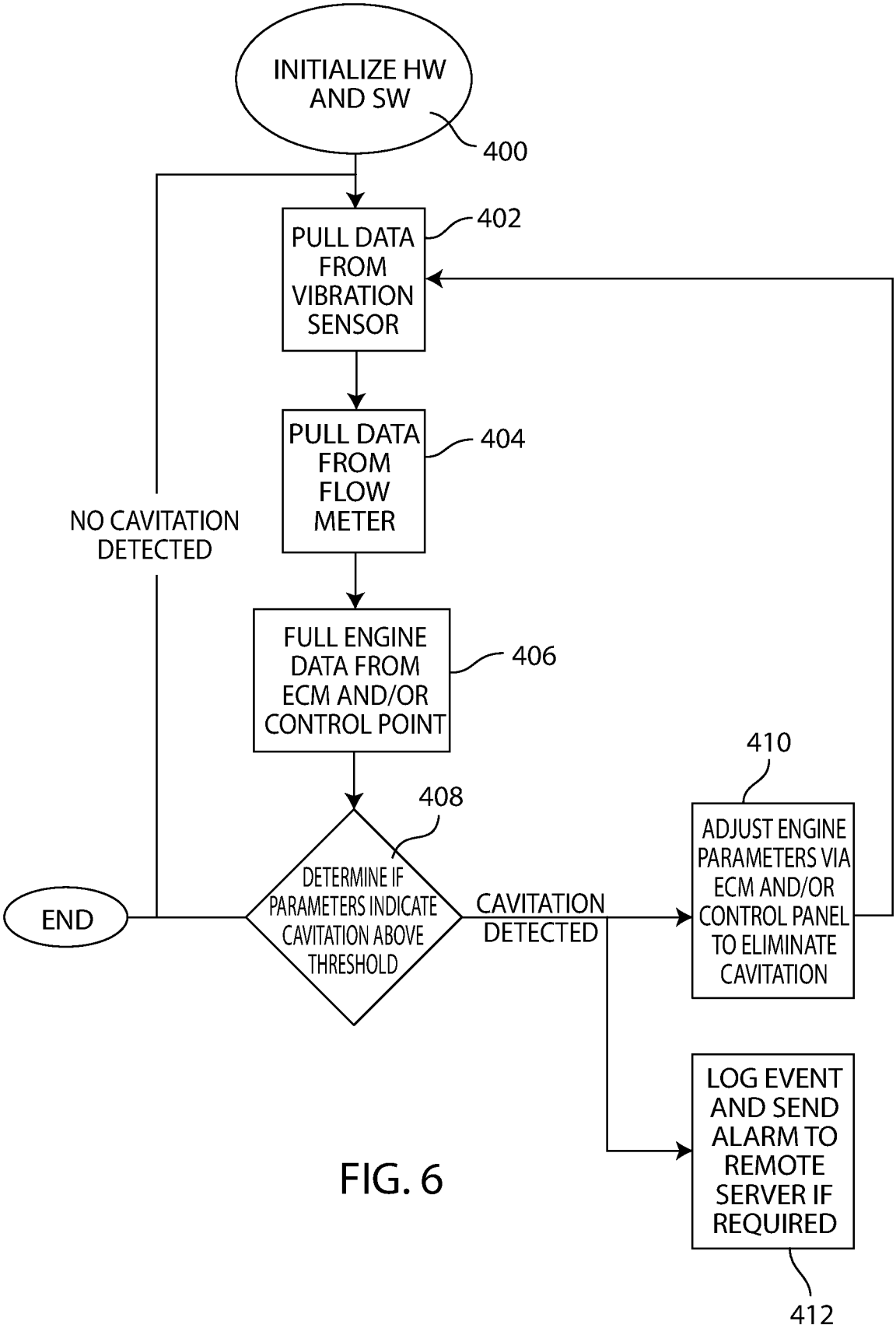
FIG. 6 is a flow chart illustrating both a method and a non-transitory programmed medium for execution on a digital processor for running the system using a single board computer.

FIG. 6 is a flow chart illustrating both a method and a non-transitory programmed medium for execution on a digital processor for running the system on a single board computer. Operation begins at block 400. This operation may begin when the engine 34 is activated. In the following blocks operating data is accessed from sensors. Order of these blocks may be changed. It is desired to show that these values are accessed at substantially the same time.

At block 402 vibration data produced by the vibration sensor 44 (FIG. 5) is accessed at the telematics module 70. At block 404 flow data from the flowmeter 200 is accessed. These parameters provide the information for use with the pumping curves of FIG. 4. At block 406 engine data is accessed from the ECM 62 and the control module 60. At block 408 data is delivered to the first processor 82 embodying the pump curves of FIG. 4. At this block 408 the first processor 82 determines if measured parameters indicate cavitation above a preselected threshold level. If no cavitation is detected, operation ends. If cavitation is detected, operation proceeds to block 410. At block 410 engine parameters are adjusted to eliminate cavitation. The parameters include engine speed. Engine speed is sensed through measurement at the flowmeter 200. Pressure head is sensed at the pressure gauge 206. In this manner information to utilize the pump curves is provided. From block 410 operation returns to block 402. In addition if cavitation is detected at block 408 operation also proceeds to block 412. At block 412 an alarm is logged in the first processor 82 and may also be sent via the telematics module 70 to the operating company 88 or to local personnel.

Figure 7:
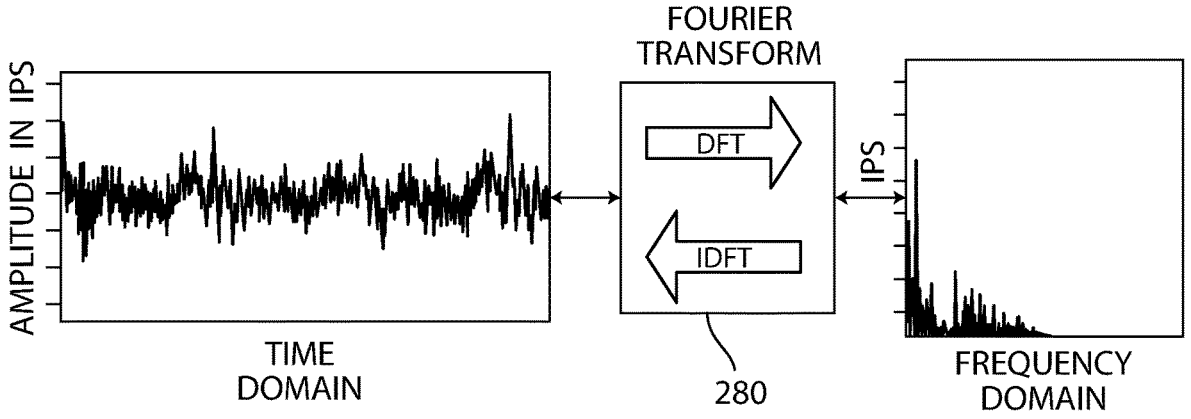
FIG. 7 is a graphical representation of a Fourier transform translating vibration data between the time domain and the frequency domain.

FIG. 7 is a graphical representation of a Fourier transform translating vibration data from the vibration sensor 44 (FIG. 1) from a first domain to a second domain. The centrifugal pump monitoring system 1 has a first domain which is time and a second domain which is frequency. The vibration sensed by vibration sensor 44 is represented by the signal it provides to the telematics module 70 (FIG. 5). This signal comprises amplitude to an arbitrary scale versus time. In the time domain the abscissa is time and the ordinate is in inches per second (IPS). In the frequency domain, the abscissa is frequency and the ordinate is IPS. The time series data is transformed to a frequency domain utilizing a discrete Fourier transform. Vibration frequency domain data is provided to the first processor 82. The first processor 82 comprises a Fourier transform module 284. The Fourier transform module 284 provides an output indicative of amplitude versus frequency for the signal provided by the vibration sensor 44. Collected data from other sensors may be indicative of additional operating parameters.

Figure 8A:
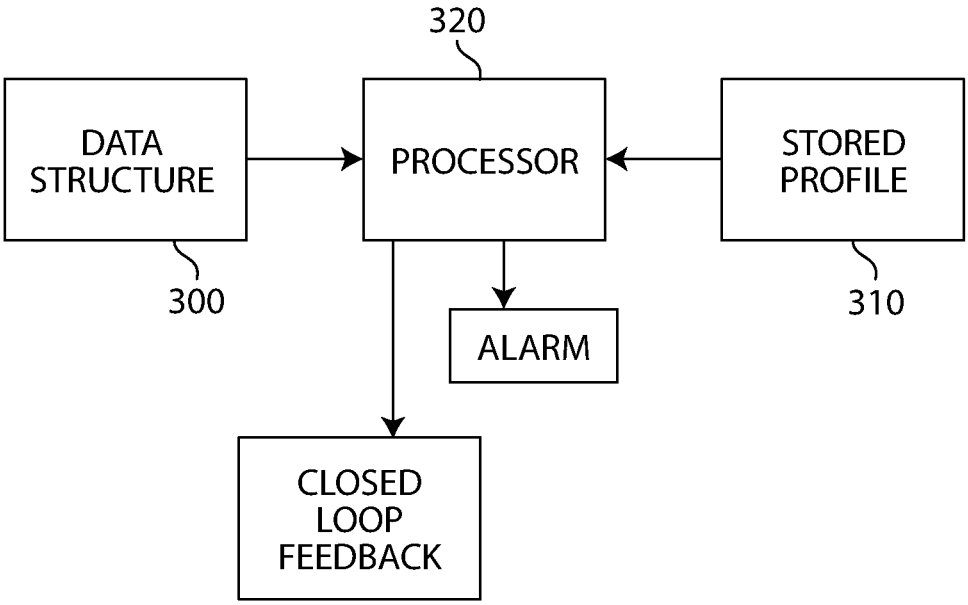
FIG. 8, consisting of FIG. 8A, FIG. 8B, and FIG. 8C, comprises block diagrams illustrating use of operating profiles and generation of operating profiles.
Figure 8B:
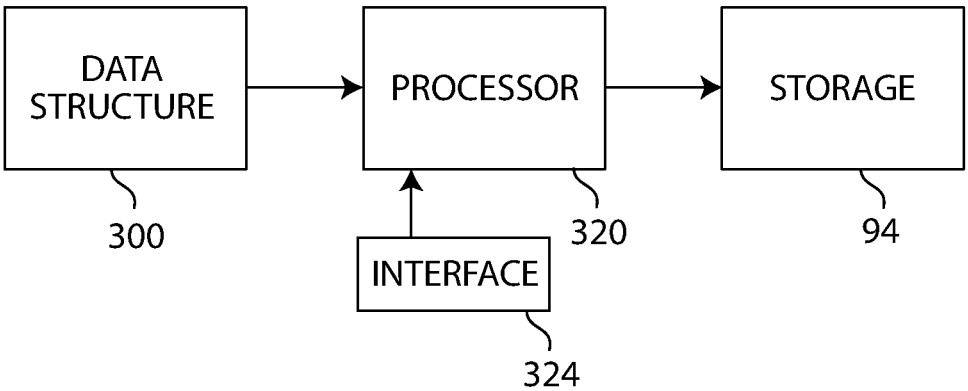
Figure 8C:
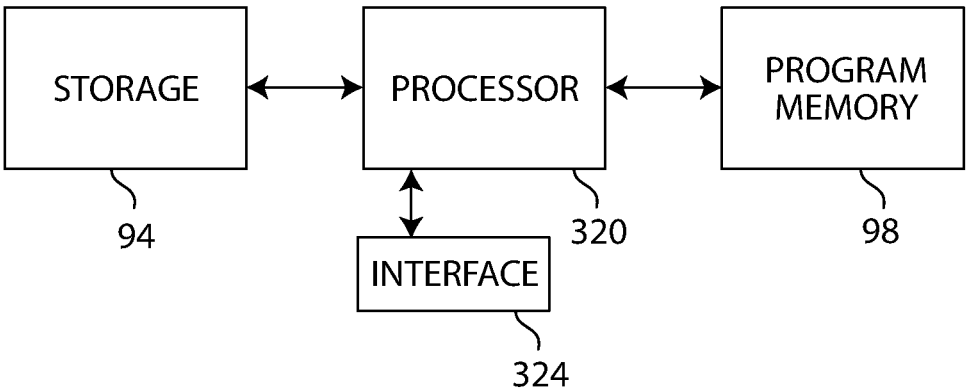

FIG. 8, consisting of FIG. 8A, FIG. 8B, and FIG. 8C, comprises block diagrams illustrating use of operating profiles and generation of operating profiles. FIG. 8A illustrates comparison of a data structure 300 provided from the telematics module 70 to at least one of the first processor 82, second processor 83, or cloud server 102. The data structure 300 is compared to a stored profile 310 at a processor 320, which may comprise any of the processors in the system. When the comparison indicates an out-of-limits condition, the processor 320 issues an alarm. The processor 320 may also issue closed loop feedback signals for controlling operation of the engine 34 and the centrifugal pump 38.

FIG. 8B illustrates generation of data collections from which profiles are generated. The data structure provides inputs to the processor 320 indicative of operating parameter values obtained at specific times. The processor 320 sorts the parameter data into groups having defined parameter values, time periods, and identity of particular machines from which data was collected. These data collections are delivered to storage 94. The inputs to the processor 320 are provided via an interface 324, for example, the graphical user interface (GUI) 66 for other locations in the system from which data can be entered.

FIG. 8C illustrates generation of profiles using the data collected in the performance row 8*b*. The processor 320 accesses selected data sets from storage 94. The processor 320 accesses selected operating applications 96 from the program memory 98. The operating applications 96 are selectively applied to process data sets into profiles. Interface 324 couples inputs to the processor 320 to define conditions to which the process data is to be correlated.

Figure 9:
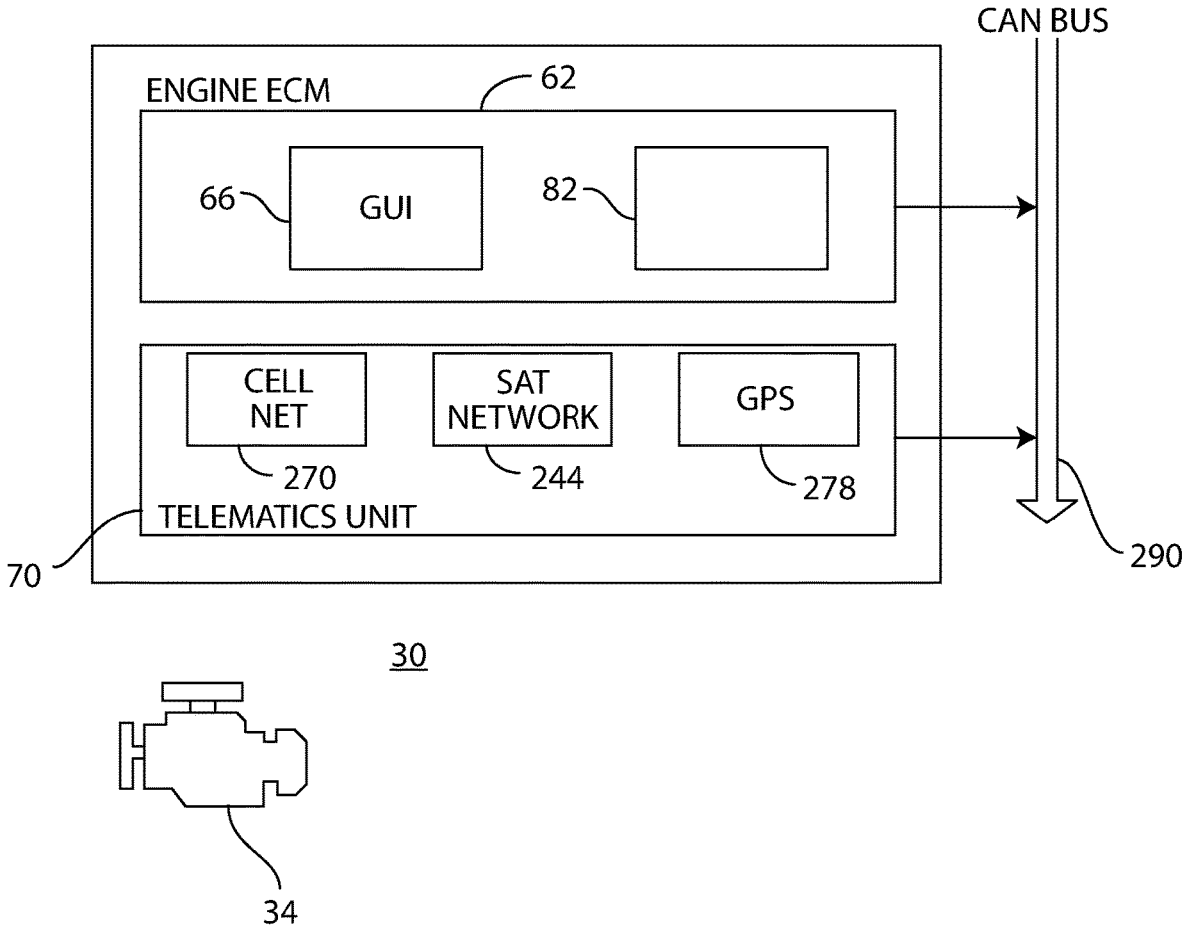
FIG. 9 is a block diagram illustrating interaction of the pumping installation with the various stakeholders in the pumping process.

FIG. 9 is a block diagram illustrating interaction of the pumping installation 30 with the various stakeholders in the pumping process. The telematics unit 70 provides communication with the outside world. Preferred interfaces include a cell network 270, a satellite network 274, and a global positioning system (GPS) 278. The electronic control module 60 is connected to the engine 34 and to the telematics module 70 by a controlled area network CAN bus 290. In a preferred embodiment, the CAN bus 290 complies with the Society of Automotive Engineers standard SAE J1939. This standard is recommended for communication and diagnostics among vehicle components. A structure defined by the International Standards Organization (ISO), Standard ISO 11898 may comprise a physical layer for cooperation with an SAE J1939 CAN bus. The CAN bus 290 uses a protocol which establishes communication between nodes. In the present illustration, nodes include the ECM 62, the engine 34, and the telematics module 70. Wireless connection enables functions and operations to be implemented by virtue of software in the ECM 62. Wiring changes are not required.

The telematics unit 70 provides for access to the first processor 82 from local offices, remote offices, and field personnel. The first processor 82 preferably includes further routines to establish an order of precedence for controlling operation. Some remote locations coupled to the telematics unit 70 can be given authority to only receive information. Personnel at the operating company 88 can have authority to override commands from other sources. Owners of pump installations 30 can monitor proper usage by pumping installation lessees.

Figure 10:
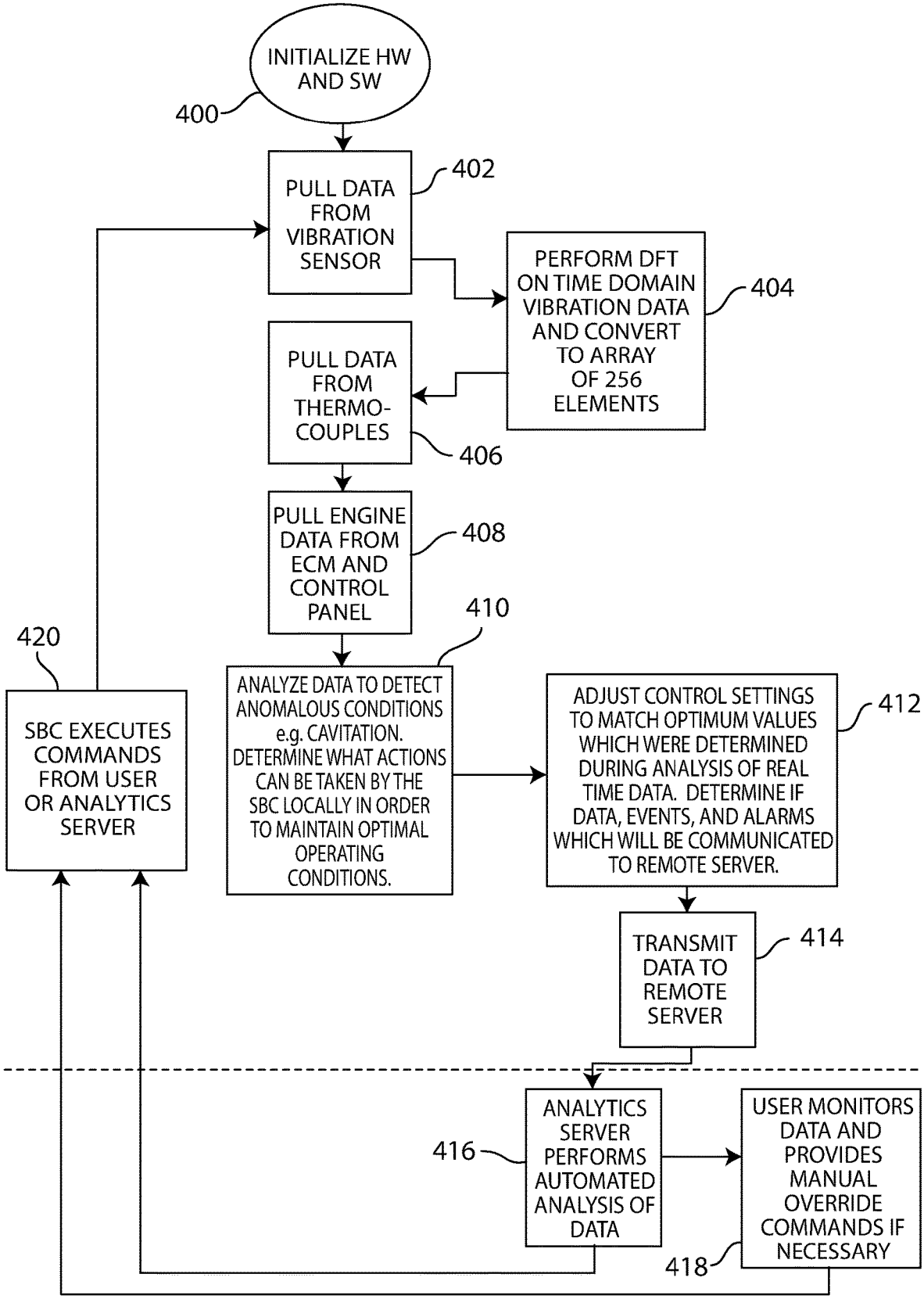
FIG. 10 is a flow chart illustrating both a method and a non-transitory programmed medium for execution on a digital processor for running the system on a single board computer for operating the instrumentation of FIG. 2.

FIG. 10 is a flow chart illustrating both a method and a non-transitory programmed medium for execution on a digital processor for running the system on a single board computer for operating the instrumentation of FIG. 2. In addition to programmed operation, a user may monitor data and provide manual override commands if desired. After operation of hardware and software is initialized, data is collected from the vibration sensor 44. The time domain data is transformed to the frequency domain and digitized.

Operation begins at block 400. Hardware and software are initialized. At block 402 data is pulled from the vibration sensor 44. At block 404 a Fourier transform translates time domain vibration data and provides an output indicative of a frequency domain spectrum. At block 406 data is pulled from the thermocouples 46 and combined in a data package with the frequency domain data. Engine data is pulled from the ECM 62 and from the engine control panel 64 at block 408. This data is combined in a data package with the thermocouple and vibration data. At block 410 the current data package is analyzed to detect anomalous conditions. The SBC 81 compares the data to stored profiles to determine available actions to maintain optimal operating conditions. In response to an output from the SBC 81, at block 412 control settings are adjusted to match preferred values that have been determined by analysis of real-time data. At block 414 data is transmitted from the telematics module 70 to a remote server such as the company server 90. At block 416 a second processor 83 performs analytics on the data. At block 418 a user 4 who is monitoring data has the option to provide manual override commands if necessary. At block 420 the single board computer 81 receives the output that have been produced at block 416 and block 418. The SBC 81 executes commands in response to the analytics server and/or a user override command. Operation for the next closed loop process returns to block 402.

A nominal example of a system according to the present subject matter comprises the following. A vibration sensor is mounted by using epoxy to the main bearing housing of a centrifugal pump. The vibration sensor data is read by a single board computer (SBC) which is also attached to the pump at a convenient location e.g. next to the control panel. The SBC collects vibration sensor data via cable or wirelessly using Bluetooth or Wi-Fi. The SBC is also collecting engine data (e.g. RPM, coolant temperature, oil pressure, etc.) from the OEM electronic control module (ECM) via the existing CAN bus network. The SBC has the ability to turn the engine on or off and also vary the RPM setpoint via the OEM control panel. The SBC wirelessly sends the data it has collected via Internet to a database. The data is used to develop models and algorithms which enable anomaly detection, preventive maintenance, and avoidance of anomalies such as cavitation. The SBC analyzes the vibration sensor and engine data in real-time and reactively adjusts engine state to maintain optimal operating conditions and/or prevent excessive wear. It performs this with low latency by running an implementation of the algorithm which was developed with previously collected engine and vibration data.

The present subject matter can obtain the following results. Real-time sensor data is used to establish trends over the lifetime of the pump. Vibration data is analyzed in the frequency domain to establish signatures which can be correlated to optimal and anomalous operating conditions. The data collected by the present subject matter will be used to develop algorithms which can be executed by a computing device which is collocated with the pump. These algorithms will enable the pump to react with low latency and maintain optimal parameters. Accurate preventive maintenance predictions by analyzing historical and real-time data is enabled.

In the foregoing detailed description, including what is described in the abstract, the method and apparatus of the present invention have been described with reference to specific exemplary embodiments thereof. It will, however, be evident that various modifications and changes may be made thereto without departing from the broader spirit and scope of the present invention. The present specification and figures are accordingly to be regarded as illustrative rather than restrictive. The description and abstract are not intended to be exhaustive or to limit the present invention to the precise forms disclosed.

The invention claimed is:

1. A centrifugal pump monitoring system for real time, in-situ, persistent monitoring of a centrifugal pump driven by an engine and controlling selected operating conditions with low latency and comparing real time operating parameter values to stored data sets indicative of selected operating conditions comprising:

a. a vibration sensor for mounting to the centrifugal pump to monitor amplitude of vibration generated by the pump and the engine, said vibration sensor comprising a 3-axis accelerometer for mounting on a main bearing housing for alignment with a pump impeller drive shaft;

b. a first processor collocated with said sensor and said pump, said processor being coupled to receive signals from said sensor, said first processor performing spectral analysis of the signals, said analysis comprising translation from a first domain to a second domain and providing data indicative thereof;

c. a control module including said first processor and further comprising a cellular modem and a satellite modem within said control module for interfacing the system and external nodes;

d. housing for mounting to the pump, said first processor being located in said housing;

e. at least one temperature probe, each said at least one temperature probe for location at a preselected point of the structure of the pump, each temperature probe providing data indicative of temperature at a respective location and being coupled to provide data to said first processor;

f. a second processor and memory comprising programs for performing analysis of data received over a selected period of time;

g. said first processor storing a stored profile indicative of an out of limit condition in the pump and comparing real-time data with the stored profile and providing an alarm signal in response to correlation of the real-time data with the profile indicative of the out of limit condition; and h. pump control circuitry responsive to the alarm signal provided from said first processor to control operating parameters of the pump requiring low latency response.

2. The centrifugal pump monitoring system according to claim 1 wherein said second processor further comprises a learning program for correlating received data with operating conditions of a pump.

3. The centrifugal pump monitoring system according to claim 2 further comprising a user interface coupled to consolidate the outputs of said first processor and said second processor, the outputs of said processors embodying intelligence for coupling to said control module, and further comprising a graphical user interface coupled to display the intelligence in human readable format.

4. The centrifugal pump monitoring system according to claim 1 wherein said processor provides a signal to shut down said pump in response to an alarm signal.

5. The centrifugal pump monitoring system according to claim 3 wherein said processor provides a signal to shut down said pump in response to an alarm signal.

* * * * *